US011660620B2

(12) United States Patent
Lin et al.

(10) Patent No.: US 11,660,620 B2
(45) Date of Patent: May 30, 2023

(54) WATER OUTLET DEVICE FOR DIFFERENT WATER SPRAYS FROM THE SAME NOZZLE

(71) Applicant: Xiamen Solex High-Tech Industries Co., Ltd., Xiamen (CN)

(72) Inventors: Fengde Lin, Xiamen (CN); Bin Cao, Xiamen (CN); Donghai Chen, Xiamen (CN)

(73) Assignee: Xiamen Solex High-Tech Industries Co., Ltd., Xiamen (CN)

( * ) Notice: Subject to any disclaimer, the term of this patent is extended or adjusted under 35 U.S.C. 154(b) by 193 days.

(21) Appl. No.: 17/080,743

(22) Filed: Oct. 26, 2020

(65) Prior Publication Data

US 2021/0121897 A1 Apr. 29, 2021

(30) Foreign Application Priority Data

Oct. 25, 2019 (CN) ..... 201911025608.9

(51) Int. Cl.
*B05B 1/16* (2006.01)
*B05B 1/18* (2006.01)

(52) U.S. Cl.
CPC ..... *B05B 1/1636* (2013.01); *B05B 1/18* (2013.01)

(58) Field of Classification Search
CPC ..... B05B 1/12; B05B 1/1636; B05B 1/18; B05B 1/185; B05B 1/3405; B05B 1/341; B05B 1/3421; B05B 1/3426; B05B 1/3468
See application file for complete search history.

(56) References Cited

U.S. PATENT DOCUMENTS 3,149,783 A * 9/1964 Sosnick ..... B05B 1/3033 239/491
4,796,815 A * 1/1989 Greenberg ..... B05B 1/3436 239/477
8,104,697 B2 * 1/2012 Petrovic ..... B05B 1/06 239/472
2018/0243764 A1 * 8/2018 Lin ..... B05B 1/169
2019/0283048 A1 * 9/2019 Rong ..... B05B 1/18

FOREIGN PATENT DOCUMENTS

CN 208661438 U 3/2019
CN 109894289 A 6/2019
NZ 745204 A 2/2019

* cited by examiner

*Primary Examiner* — Darren W Gorman
(74) *Attorney, Agent, or Firm* — Cooper Legal Group, LLC

(57) ABSTRACT

A water outlet device for different water sprays from a same nozzle comprises a water outlet portion, and a control mechanism, the water outlet portion comprises a water outlet nozzle, the water outlet nozzle comprises a water outlet, the water outlet nozzle further comprises at least two water inlets, flow directions of the at least two water inlets are not parallel to a flow direction of the water outlet, the control mechanism is connected to the at least two water inlets to control a water inlet condition of each of the at least two water inlets, the water inlet condition comprises at least one of a flow volume or whether the water is flowing or not flowing, and the control mechanism controls the water inlet condition of each of the at least two water inlets to enable the water outlet nozzle to discharge the different water sprays.

22 Claims, 19 Drawing Sheets

WATER OUTLET DEVICE FOR DIFFERENT WATER SPRAYS FROM THE SAME NOZZLE

RELATED APPLICATIONS

This application claims priority to Chinese patent application number 201911025608.9, filed on Oct. 25, 2019. Chinese patent application number 201911025608.9 is incorporated herein by reference.

FIELD OF THE DISCLOSURE

The present disclosure relates to a water outlet mechanism, and in particular relates to a water outlet device for different water sprays from the same nozzle.

BACKGROUND OF THE DISCLOSURE

Water outlet devices comprise a water outlet portion, and the water outlet portion comprises a water outlet nozzle. The water outlet nozzle has a water inlet and a water outlet, and the water outlet only discharges a single type of water spray (e.g., a single function water outlet, such as a shower water spray on the existing market). To solve the above deficiencies, there are two solutions.

The first solution, such as described in CN208661438U, CN109894289A in the Chinese patent database, includes a water outlet nozzle that has a water inlet and a water outlet, and the water outlet device is also disposed with a movable portion, an operating portion, and a driving mechanism. The driving mechanism is operatively connected to the movable portion and drives the movable portion to move cyclically. The movable portion is movably disposed in a fixed portion and comprises a movable plate and a plurality of convex portions convexly arranged on the movable plate. The convex portions are inserted into the water outlet nozzle, and there is a gap between the water outlet nozzle and the convex portions. The operating portion drives the movable portion to move at least between a first position and a second position. Different water sprays are discharged when the movable portion is in the first position and the second position. The water spray pattern is simple.

The second solution, such as described in NZ745204A, includes a water outlet nozzle that has two water inlets and one water outlet. One water inlet (i.e., an inner port of the water outlet nozzle) flows in the same direction as the water outlet, and the other water inlet is located on a peripheral wall of the water outlet. By controlling water flowing into the two water inlets, the water outlet of the water outlet nozzle can be controlled to discharge different water sprays.

Although the above two solutions can produce different water sprays in the same nozzle, there are still the following deficiencies: the water spray is monotonous and the effect of the water spray can be improved.

BRIEF SUMMARY OF THE DISCLOSURE

The present disclosure provides a water outlet device for different water sprays in the same nozzle, which overcomes the deficiencies of the water outlet device for different water sprays in the same nozzle in the existing techniques.

In order to solve the aforementioned technical problems, a technical solution of the present disclosure is as follows.

A water outlet device for different water sprays from a same nozzle comprises a water outlet portion, and a control mechanism, the water outlet portion comprises a water outlet nozzle, the water outlet nozzle comprises a water outlet, the water outlet nozzle further comprises at least two water inlets, flow directions of the at least two water inlets are not parallel to a flow direction of the water outlet, the control mechanism is connected to the at least two water inlets to control a water inlet condition of each of the at least two water inlets, the water inlet condition comprises at least one of a flow volume or whether water is flowing or not flowing, and the control mechanism controls the water inlet condition of each of the at least two water inlets to enable the water outlet nozzle to discharge the different water sprays.

In a preferred embodiment, a flow direction of a first water inlet of the at least two water inlets is disposed along a direction tangent to the water outlet to enable water from the first water inlet to flow into the water outlet nozzle to generate a vortex.

In a preferred embodiment, a flow direction of a second water inlet of the at least two water inlets intersects with an axial direction of the water outlet nozzle.

In a preferred embodiment, a flow direction of a first water inlet of the at least two water inlets is disposed along a direction tangent to the water outlet to enable water from the first water inlet to flow into the water outlet nozzle to generate a vortex, and a flow direction a second water inlet of the at least two water inlets intersects with an axial direction of the water outlet nozzle.

In a preferred embodiment, a bottom surface of the first water inlet is lower than a bottom surface of the second water inlet.

In a preferred embodiment, a linear extension of the first water inlet is disposed on a front side of the second water inlet.

In a preferred embodiment, the flow directions of the at least two water inlets are disposed on a same plane.

In a preferred embodiment, the flow directions of the at least two water inlets intersect.

In a preferred embodiment, a plane disposed with the flow directions of the at least two water inlets is perpendicular to an axial direction of the water outlet nozzle.

In a preferred embodiment, the water outlet device further comprises an installation portion, the installation portion comprises a cover and a cover plate body, the cover is fixedly connected to the cover plate body, the cover is disposed with the water outlet nozzle, and the cover plate body is hermetically connected to an inner port of the water outlet nozzle.

In a preferred embodiment, the water outlet nozzle is disposed with a surrounding wall protruding from a rear surface of the cover and surrounding the inner port of the water outlet nozzle, the surrounding wall comprises a through hole penetrating an inner side and an outer side of the surrounding wall, the through hole is disposed with a first water inlet of the at least two water inlets, a rear end surface of the surrounding wall is concave to define a second water inlet of the at least two water inlets in communication with the inner port of the water outlet nozzle, and the cover plate body is hermetically connected to and covers the rear end surface of the surrounding wall.

In a preferred embodiment, the surrounding wall comprises a curved wall and a protruding portion connected to two ends of the curved wall, a rear end surface of the protruding portion is concave to define a groove in communication with the inner port of the water outlet nozzle, and the groove defines the second water inlet.

In a preferred embodiment, the first water inlet is disposed at a connection position of the curved wall and the protruding portion.

In a preferred embodiment, the water outlet nozzle is disposed with a surrounding wall protruding from a rear surface of the cover and surrounding the inner port of the water outlet nozzle, the surrounding wall comprises a through hole penetrating an inner side and an outer side of the surrounding wall, the through hole is disposed with a second water inlet of the at least two water inlets, a rear end surface of the surrounding wall is concave to define a groove, the groove comprises a water passing groove, and the water passing groove defines a first water inlet of the at least two water inlets in communication with the inner port of the water outlet nozzle.

In a preferred embodiment, the water passing groove comprises a connecting section, an arc section, and a water inlet section, the arc section is connected between the connection section and the water inlet section, and the connecting section is disposed along a tangential line of the water outlet nozzle and is disposed with the first water inlet.

In a preferred embodiment, the cover is hermetically and fixedly connected to the cover plate body to define a water dividing chamber, a first water inlet of the at least two water inlets is in communication with the water dividing chamber, and the cover plate body comprises a water passing hole in communication with a second water inlet of the at least two water inlets.

In a preferred embodiment, the installation portion further comprises a water divider, a fixed base, and a water inlet passage, the water divider is hermetically and fixedly connected to the fixed base to define a water outlet chamber, the water inlet passage is in communication with the water outlet chamber, the water divider is hermetically and fixedly connected to the cover plate body to define another water dividing chamber, and the water passing hole is in communication with the another water dividing chamber, and the control mechanism is connected to the water outlet chamber, the water dividing chamber, and the another water dividing chamber.

In a preferred embodiment, the water divider comprises one or more water dividing holes selectively connected to the water dividing chamber and the another water dividing chamber, the control mechanism comprises a water dividing plate, and the water dividing plate is rotatably connected to the water divider to control the water dividing chamber and the another water dividing chamber to selectively be in communication with the one or more water dividing holes and to control the flow volume.

In a preferred embodiment, the water outlet device further comprises a driving mechanism, the driving mechanism is operatively connected to the water dividing plate and drives the water dividing plate to achieve a stepless rotation adjustment.

In a preferred embodiment, the driving mechanism comprises a cam-connecting rod mechanism, and the cam-connecting rod mechanism is operatively connected to the water dividing plate to drive the water dividing plate to rotate.

In a preferred embodiment, the driving mechanism further comprises a slider, the cam-connecting rod mechanism comprises a push rod and a swing rod, the slider and the push rod are configured to slide relative to the installation portion, the slider is operatively connected to the push rod to enable the push rod to slide to drive the slider to slide, the push rod is connected with a connecting pin, the swing rod comprises a slot, the connecting pin is coupled in the slot, and the swing rod and the water dividing plate rotate synchronously.

In a preferred embodiment, the driving mechanism further comprises a push button, the push button is slidably connected to the installation portion, and the push button is operatively connected to the slider.

In a preferred embodiment, the driving mechanism comprise a positioning block, the slider comprises a mounting groove, the positioning block is coupled in the mounting groove, the positioning block comprises a mounting hole, the push rod is fixedly disposed with a fixed rod, and the fixed rod is coupled in the mounting hole.

In a preferred embodiment, the cam-connecting rod mechanism comprises a dial rod and a swing rod, one end of the dial rod is rotatably connected to the installation portion, one end of the swing rod is connected to the water dividing plate, another end of the swing rod is operatively connected to the dial rod, the dial rod rotates to drive the another end of the swing rod to swing, and the swing rod swings to drive the water dividing plate to rotate.

In a preferred embodiment, an inner side of the dial rod comprises a matching groove, the other end of the swing rod protrudes to define a round portion, and the round portion is connected to an inner side of the matching groove.

In a preferred embodiment the driving mechanism comprises a dial button, the dial rod comprises an arc-shaped member and a connecting base fixedly connected to an inner side of the arc-shaped member, the connecting base is operatively connected to the installation portion, and an inner end of the dial button is disposed in the arc-shaped member.

In a preferred embodiment, the control mechanism comprises a sliding switching mechanism.

In a preferred embodiment, the water outlet device is a kitchen faucet.

In a preferred embodiment, the water outlet device is a shower.

Compared with the existing techniques, the technical solution has the following advantages.

First, the flow directions of the water inlets and the flow direction of the water outlet are not parallel, and the water flowing in through the two water inlets can impact each other to generate new water sprays. Second, the control mechanism steplessly control the water inlet conditions of the two water inlets of a nozzle water outlet to achieve a gradual change of different water spray patterns, and a goal of different water sprays from the same nozzle is achieved. At the same time, in a use state, when water flows out of all the water outlets at the same time, the water sprays are fuller, a coverage area of the water spray is larger, and a water outflow is more uniform.

The bottom surface of the first water inlet is lower than the bottom surface of the second water inlet. When two streams of water collide, the vortex of the first water inlet is not easily dissipated, and the resulting water spray effect is better.

The linear extension of the first water inlet is disposed on a front side of the second water inlet, and the water flow through the second water inlet impacts on the vortex to generate new water sprays.

BRIEF DESCRIPTION OF THE DRAWINGS

The present disclosure will be further described below in combination with the accompanying drawings and embodiments.

DETAILED DESCRIPTION OF THE EMBODIMENTS

Embodiment 1

Figure 1:
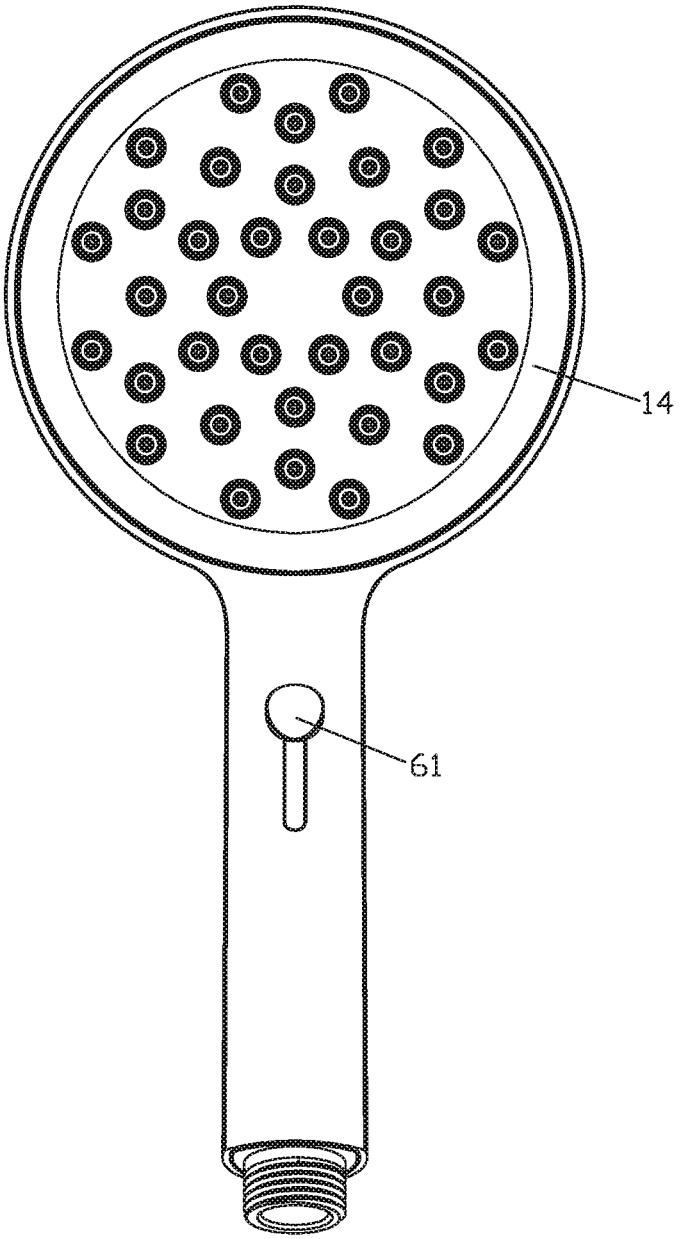
FIG. 1 illustrates a perspective view of a handheld shower in Embodiment 1.
Figure 2:
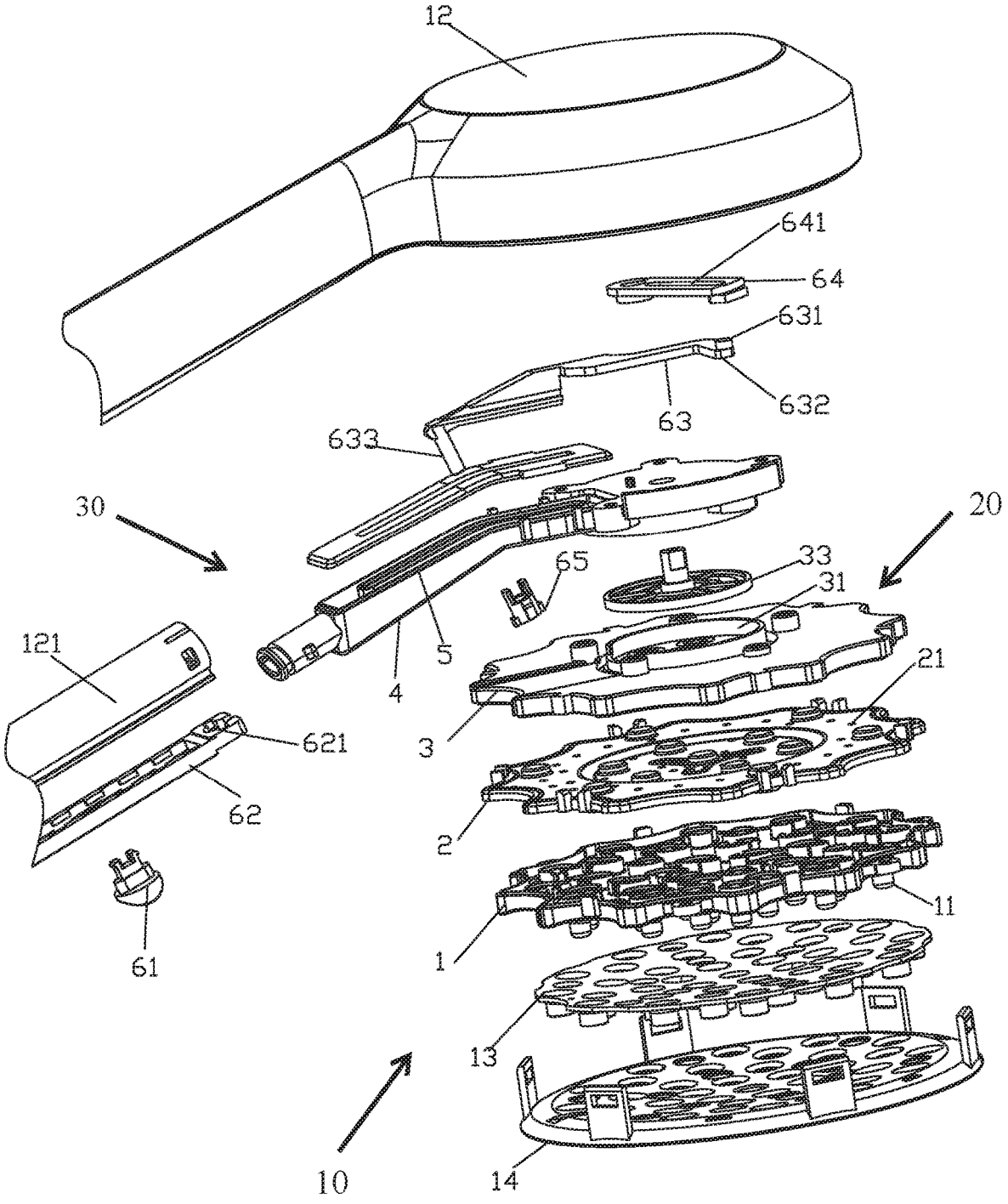
FIG. 2 illustrates an exploded perspective view of the handheld shower in Embodiment 1.
Figure 3:
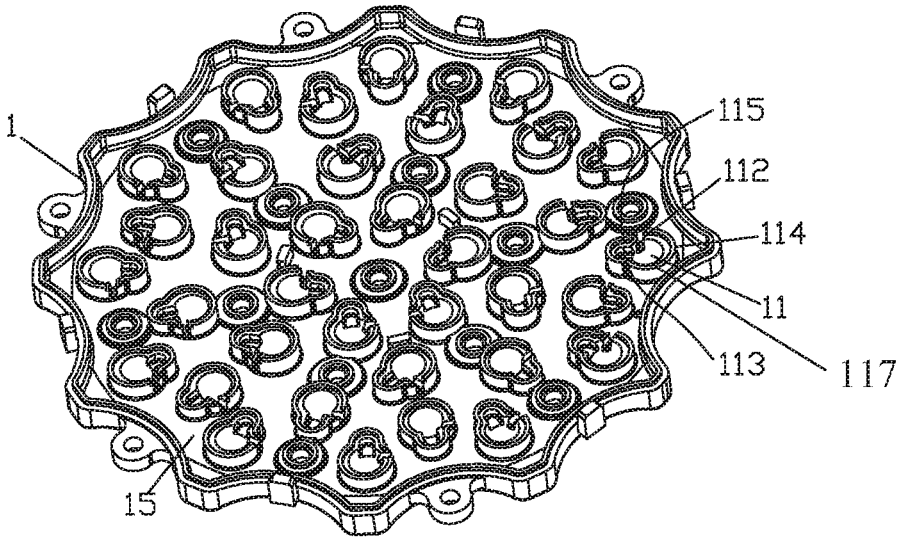
FIG. 3 illustrates a perspective view of a cover in Embodiment 1.
Figure 4:
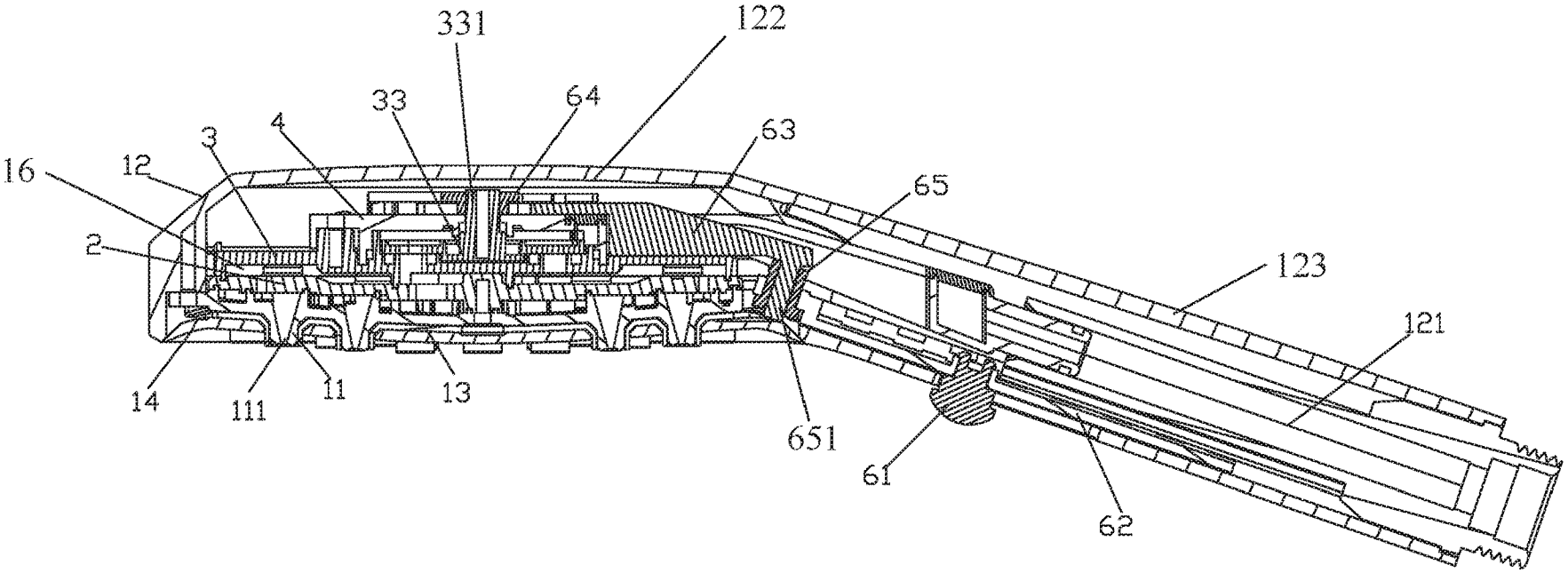
FIG. 4 illustrates a cross-sectional view of the handheld shower in Embodiment 1.

Referring to FIGS. 1-12, a water outlet device is a handheld shower comprising an installation portion 10, a control mechanism 20, and a driving mechanism 30. The installation portion 10 comprises a cover 1, a cover plate body 2, a water divider 3, a fixed base 4, and a water inlet passage 5.

The cover 1 comprises a plurality of water outlet nozzles 11. A water outlet nozzle 11 (i.e., each of the plurality of water outlet nozzles 11 or a single water outlet nozzle 11 of the plurality of water outlet nozzles 11) comprises a water outlet 111, a first water inlet 112, and a second water inlet 113. A flow direction of the first water inlet 112 extends along a direction tangent to the water outlet nozzle 11 to enable the water from the first water inlet 112 to flow into the water outlet nozzle 11 to generate a vortex. A flow direction of the second water inlet 113 intersects with an axial direction of the water outlet nozzle 11. For example, where a flow direction of the water outlet 111 downwardly extends along the axial direction of the water outlet nozzle 11, the flow directions of the first water inlet 112 and the second water inlet 113 are horizontally disposed. That is, a plane disposed with the flow directions of the first water inlet 112 and the second water inlet 113 is perpendicular to the axial direction of the water outlet nozzle 11. Thus, the flow directions of the first water inlet 112 and the second water inlet 113 are not parallel to the flow direction of the water outlet 111. In this embodiment, the flow directions of the first water inlet 112 and the second water inlet 113 intersect, a bottom surface of the first water inlet 112 is lower than a bottom surface of the second water inlet 113, and a linear extension of the flow direction of the first water inlet 112 is disposed on a front side (i.e., a lower side) of the second water inlet 113.

The cover 1 cooperates with the cover plate body 2 to define a water outlet portion. A circumference of the cover 1 is hermetically and fixedly connected to a circumference of the cover plate body 2, and the cover plate body 2 is hermetically connected to an inner opening of the water outlet nozzle 11. The water outlet nozzle 11 comprises a surrounding wall 114 protruding from a rear surface of the cover 1 and surrounding the inner opening of the water outlet nozzle 11. The surrounding wall 114 comprises a through hole penetrating an inner side and an outer side of the surrounding wall 114, and the through hole defines the first water inlet 112. A rear end surface of the surrounding wall 114 is concave to define the second water inlet 113, which is in communication with the inner opening of the water outlet nozzle 11. The cover plate body 2 is disposed with a water passing hole 21 in communication with the second water inlet 113. In this embodiment, the surrounding wall 114 comprises a curved wall 117 and a protruding portion 115 connected to two ends of the curved wall 117. An end surface of the protruding portion 115 is concave to define a groove, which is in communication with the inner opening of the water outlet nozzle 11. The groove defines the second water inlet 113. The cover plate body 2 is hermetically connected to and covers an inner end surface of the surrounding wall 114, and a lower opening of the water passing hole 21 is disposed on an upper side of the groove. The first water inlet 112 is disposed at a connection position of the curved wall 117 and the protruding portion 115.

The water divider 3 is hermetically and fixedly connected to the fixed base 4 to define a water outlet chamber 31, and the water inlet passage 5 is in communication with the water outlet chamber 31. The water divider 3 is hermetically and fixedly connected to the cover plate body 2 to define a second water dividing chamber 16, and the circumference of the cover 1 is hermetically and fixedly connected to the circumference of the cover plate body 2 to define a first water dividing chamber 15. The first water dividing chamber 15 is in communication with the first water inlets 112 of each of the plurality of water outlet nozzles 11, and each of the water passing holes 21 of the cover plate body 2 is respectively in communication with the second water inlet 113 of each of the plurality of water outlet nozzles 11.

The control mechanism 20 is connected to the water outlet chamber 31, the first water dividing chamber 15, and the second water dividing chamber 16. The first water dividing chamber 15 and the second water dividing chamber 16 are respectively in communication with the first water inlet 112 and the second water inlet 113 to control a water inlet condition of each of the first water inlet 112 and the second water inlet 113. The water inlet condition comprises a flow volume and whether the water is flowing or not flowing, and the water inlet condition of each of the first water inlet 112 and the second water inlet 113 are controlled to enable the water outlet 111 of the water outlet nozzle 11 to discharge different water sprays. In this embodiment: a top surface of the water divider 3 is disposed with water dividing holes 32 corresponding to the first water dividing chamber 15 and the second water dividing chamber. The control mechanism 20 comprises a water dividing plate 33, and a bottom surface of the water dividing plate 33 is connected to the top surface of the water divider 3. The water dividing plate 33 is rotatably connected to the water divider 3 so that the water dividing plate 33 rotates to control whether the water outlet chamber 31 is in communication with the water divider holes 32 and to control a flow volume. The water dividing plate 33 comprises a water dividing shaft 331, and the water dividing shaft 331 hermetically and rotatably extends out of an upper side of the fixed base 4. The water dividing shaft 331 is configured to drive the water dividing plate 33 to rotate and is configured to control whether the water dividing holes 32 are in communication with the water outlet chamber 31 and to control a size of a communication area in communication with the water outlet chamber 31 (the larger the communication area, the greater the flow volume, and the smaller the communication area, the smaller the flow volume).

The driving mechanism 30 is operatively connected to the water dividing shaft 331 of the water dividing plate 33 and drives the water dividing plate 33 to achieve a stepless rotation adjustment. That is, an angle of a relative rotation of the water dividing plate 33 can be controlled steplessly, and the water dividing plate 33 can be controlled to any position within a preset rotation angle. The driving mechanism 30 comprises a push button 61, a slider 62, a push rod 63, and a swing rod 64. The push button 61, the slider 62, and the push rod 63 are each configured to slide relative to the installation portion 10. The push button 61 is fixedly connected to a first end of the slider 62 so that a user can operate the push button 61 to drive the slider 62 to slide. A second end of the slider 62 is connected to a first end of the push rod 63 by a positioning block 65 so that the slider 62 slides to drive the push rod 63 to slide. A first end of the swing rod 64 is fixedly connected to the water dividing shaft 331 of the water dividing plate 33 so that the swing rod 64 and the water dividing plate 33 rotate synchronously. The push rod 63 is fixedly connected with a connecting pin 631, and the swing rod 64 comprises a long slot 641. The connecting pin 631 is coupled in the long slot 641, and a sliding movement of the push rod 63 is configured to drive the connecting pin 631 to slide so as to drive the swing rod 64 to swing, to drive the water dividing shaft 331 to rotate, and to drive the water dividing plate 33 to rotate. In this embodiment, the slider 62 comprises a mounting groove 621, and the positioning block 65 is coupled in the mounting groove 621 so that the positioning block 65 is fixedly connected to the slider 62. The positioning block 65 comprises a mounting hole 651, and the push rod 63 is fixedly disposed with a fixed rod 633. The fixed rod 633 is coupled in the mounting hole 651, and the push rod 63 is slidably connected to the fixed base 4. A second end of the push rod 63 is disposed with a swing arm 632, and the connecting pin 631 is fixedly connected to the swing arm 632. Therefore, the entirety of the driving mechanism 30 is more compact. The swing arm 632 cooperates with the push rod 63 to define a cam-connecting rod mechanism. In this embodiment, the cam-connecting rod mechanism can also be other structures. An operation member (in this embodiment, the push button 61) is operatively connected to the cam-connecting rod mechanism, and the cam-connecting rod mechanism is operatively connected to the water dividing shaft 331 of the water dividing plate 33. The operation member is configured to move relative to the installation portion to drive the cam-connecting rod mechanism to move so as to drive the water dividing plate 33 to achieve a stepless angle adjustment. For a given rotation angle of the water dividing plate 33, the longer the swing arm 632 of the cam-connecting rod mechanism, the longer a required distance of the push button 61, and the smaller a force of the push button 61. For the given rotation angle of the water dividing plate 33, the shorter the swing arm 632 of the cam-connecting rod mechanism, the shorter the required distance of the push button 61 and the greater the force of the push button 61. Therefore any required working distant can be adjusted according to user needs. The driving mechanism 30 enables the user to adjust a rotation angle of the water dividing plate 33 steplessly, which can not only control whether water is flowing out but also control flow volumes of the first water inlet 112 and the second water inlet 113. Moreover, the driving mechanism 30 of this embodiment has a reasonable arrangement, a compact structure, and a stable and reliable operation connection.

The installation portion 10 further comprises a body 12, a decorative ring 13, and a decorative cover 14. The body 12 is disposed with a head 122 and a handle 123 fixedly connected together. The head 122 of the body 12 is fixedly connected to the decorative cover 14 in an upper-and-lower direction (i.e., a vertical direction), and the fixed base 4, the water divider 3, the cover plate body 2, and the cover 1 are fixedly connected between the head 122 of the body 12 and the decorative cover 14 in a downward direction. The decorative ring 13 is disposed between the cover 1 and the decorative cover 14. An inner side of the handle 123 is disposed with an axial shaft 121. The water inlet passage 5 comprises a portion disposed on the axial shaft 121 and the fixed base 4, and the water inlet passage 5 also comprises the water outlet chamber 31. The water source flows into the water outlet chamber 31 through the axial shaft 121 and the fixed base 4.

Figure 5:
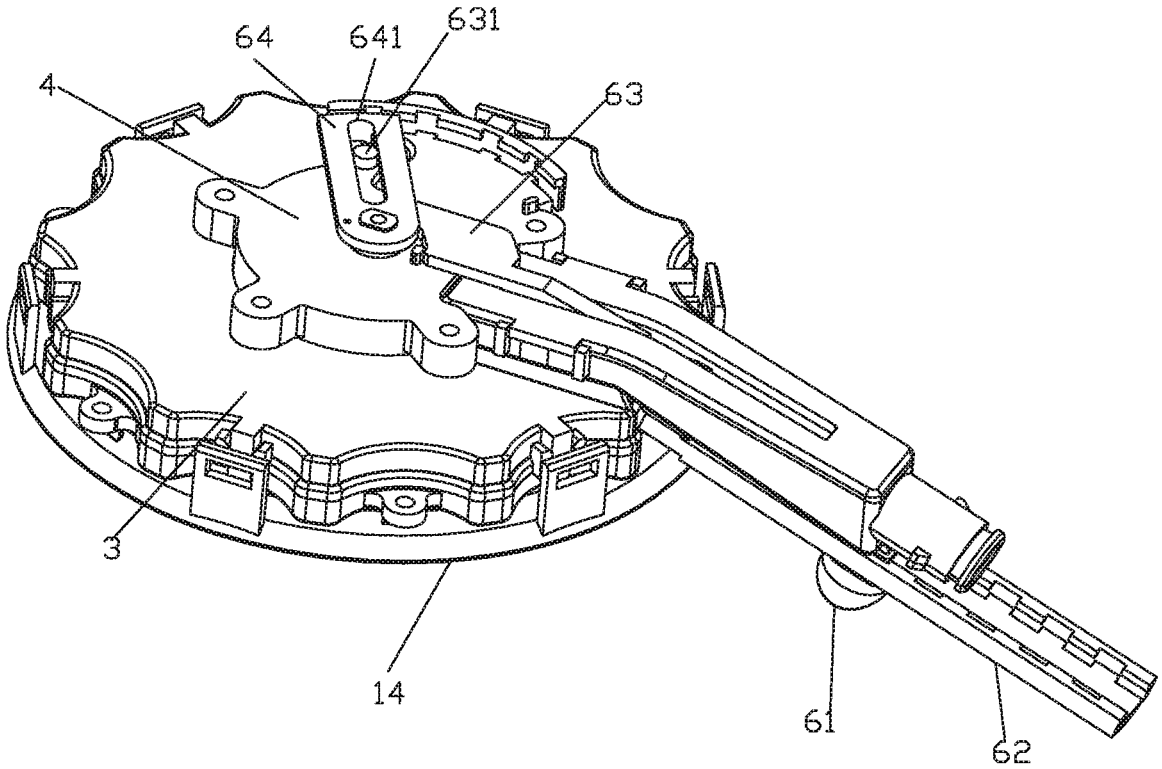
FIG. 5 illustrates a perspective view of a portion comprising a driving mechanism in Embodiment 1 when a water dividing plate is in a first position.
Figure 6:
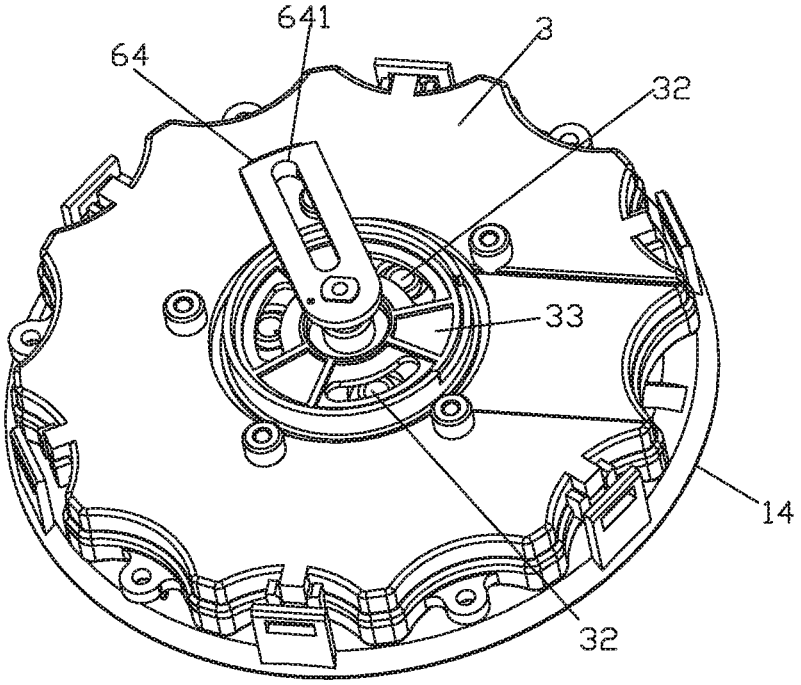
FIG. 6 illustrates a perspective view of a portion comprising a control mechanism in Embodiment 1 when the water dividing plate is in the first position.
Figure 7:
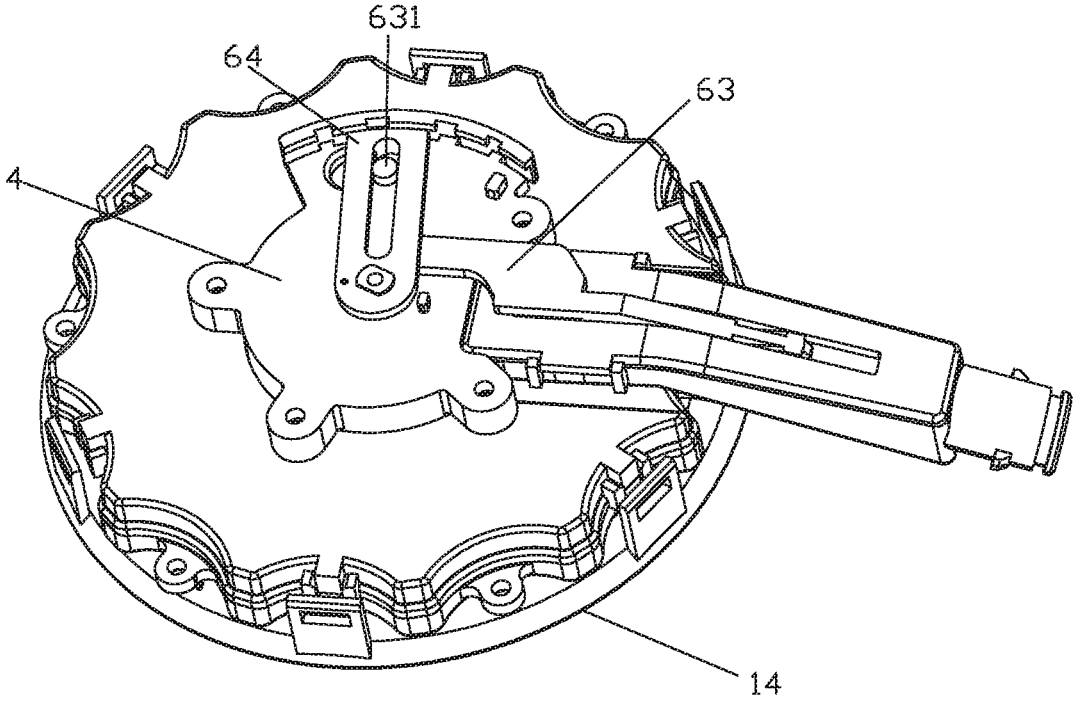
FIG. 7 illustrates a perspective schematic view of the portion comprising the driving mechanism in Embodiment 1 when the water dividing plate is in a second position.
Figure 8:
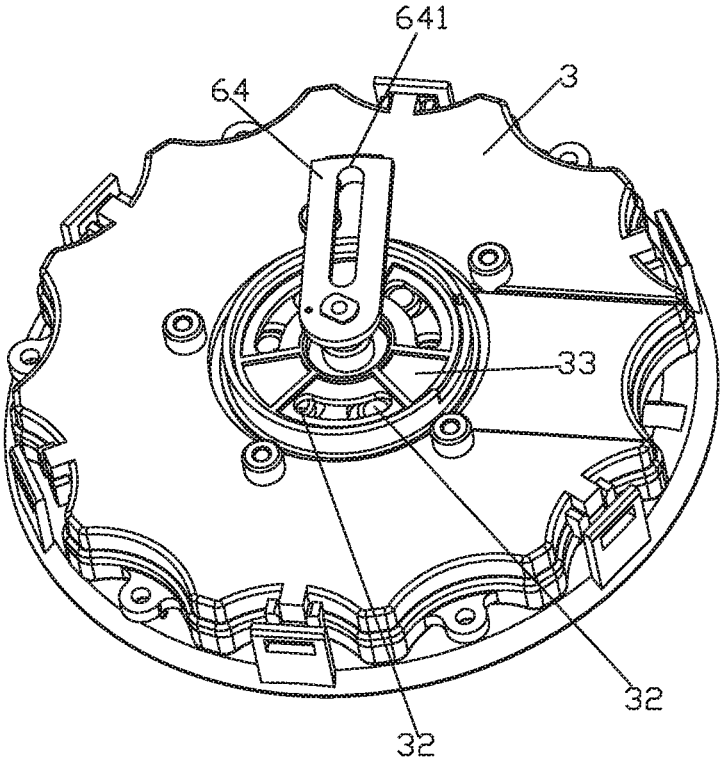
FIG. 8 illustrates a perspective view of the portion comprising the control mechanism in Embodiment 1 when the water dividing plate is in the second position.
Figure 9:
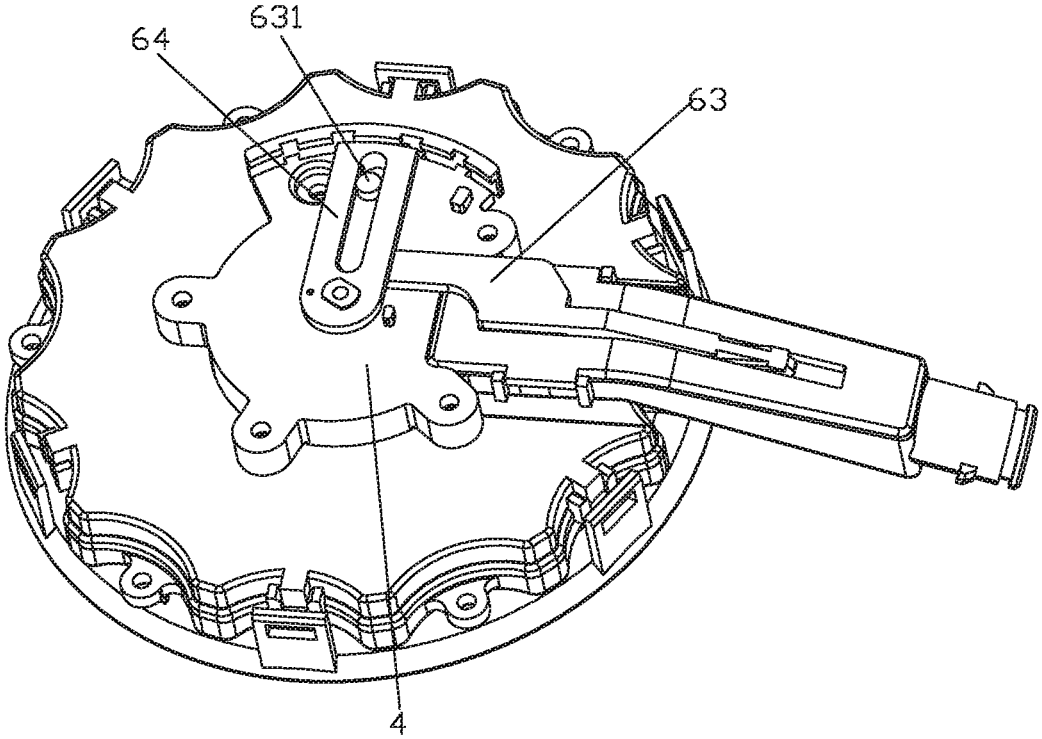
FIG. 9 illustrates a perspective view of the portion comprising the driving mechanism in Embodiment 1 when the water dividing plate is in a third position.
Figure 10:
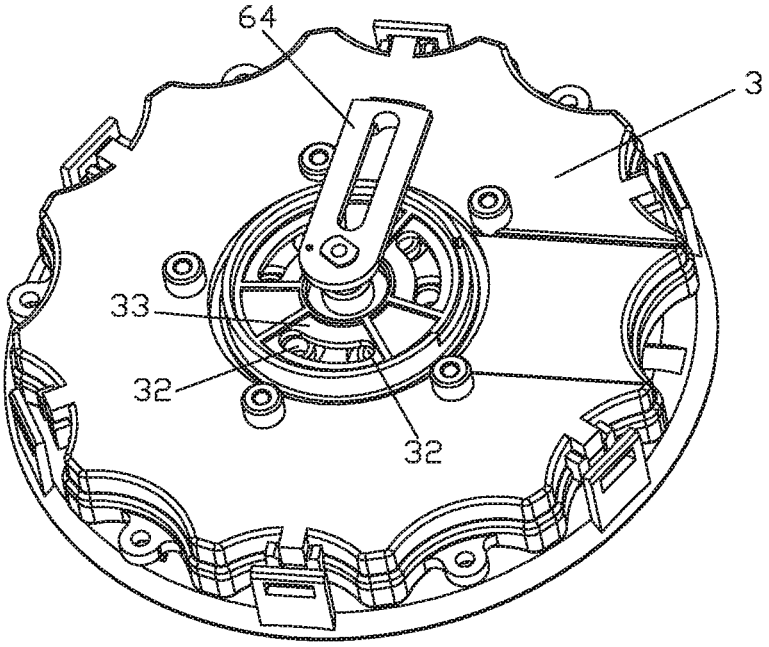
FIG. 10 illustrates a perspective view of the portion comprising the control mechanism in Embodiment 1 when the water dividing plate is in the third position.
Figure 11:
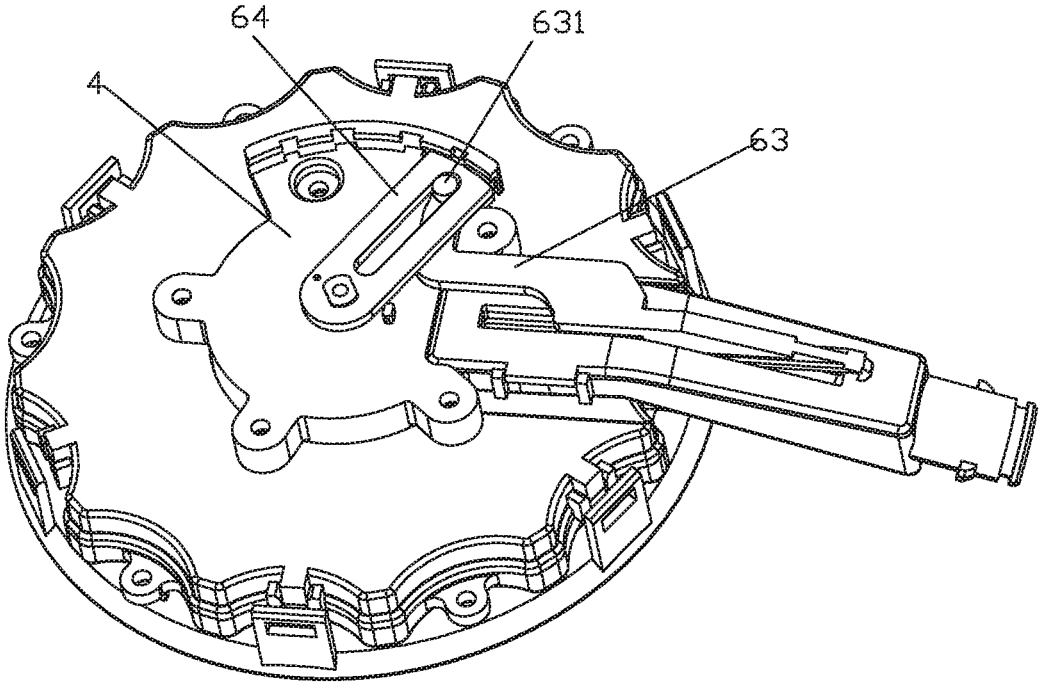
FIG. 11 illustrates a perspective view of the portion comprising the driving mechanism in Embodiment 1 when the water dividing plate is in a fourth position.
Figure 12:
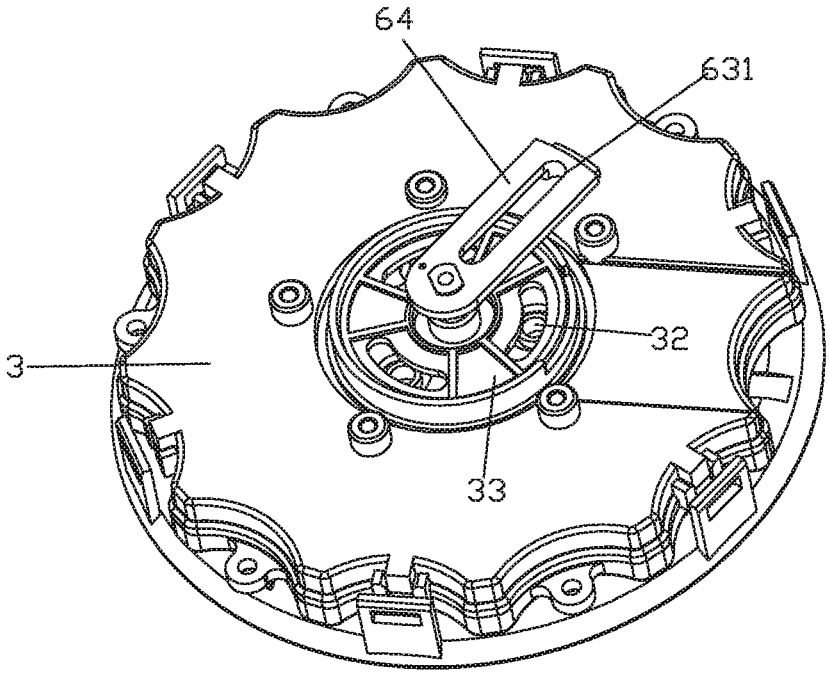
FIG. 12 illustrates a perspective view of the portion comprising the control mechanism in Embodiment 1 when the water dividing plate is in the fourth position.

The push button 61 slides back and forth, the slider 62 is fixedly connected to the push button 61, and the slider 62 and the push button 61 move synchronously. The push button 61 moves back and forth and drives the water dividing plate 33 to rotate back and forth through the cam-connecting rod mechanism, and then a change of a mixing area (a flow volume) of the first water inlet 112 and the second water inlet 113 of the water outlet nozzle 11 is adjusted and controlled steplessly to enable a gradual change of a pattern of atomized water, lantern water, particle water, and shower water. Referring to FIGS. 5 and 6, when the water dividing plate 33 is in a first position, water flows into the first water inlet 112, the second water inlet 113 is closed, the water from the water source is introduced into the first water inlet 112, and atomized water flows out of the water outlet nozzle 11. Referring to FIGS. 7 and 8, when the water dividing plate 33 is in a second position, water flows into the first water inlet 112, water flows into the second water inlet 113, a flow volume of the first water inlet 112 is greater than a flow volume of the second water inlet 113, a vortex water of the first water inlet 112 collides with a column-shaped shower water of the second water inlet 113, the flow volume of the vortex water is greater than the flow volume of column-shaped shower water, and lantern water flows out of the water outlet nozzle 11. Referring to FIGS. 9 and 10, when the water dividing plate 33 is in a third position, water flows into the first water inlet 112, water flows into the second water inlet 113, the flow volume of the second water inlet 113 is greater than the flow volume of the first water inlet 112, the vortex water of the first water inlet 112 collides with the column-shaped shower water of the second water inlet 113, the flow volume of the column-shaped shower water is greater than the flow volume of the vortex water, and the particle water flows out of the water outlet nozzle 11. Referring to FIGS. 11 and 12, when the water dividing plate 33 is in a fourth position, water flows into the second water inlet 113, the first water inlet 112 is closed, the water from the water source is introduced into the second water inlet 113, and the column-shaped shower water flows out of the water outlet nozzle 11.

In this embodiment, the water outlet device has the following advantages. A variety of water sprays (i.e., water spray patterns) flow out of the same water outlet. In each of functional water spray states, each of the plurality of water outlets concurrently discharge water, a water spray is fuller, a cover area of the water spray is larger, and a water outflow is more uniform. When a multi-function shower is switched to the next gear position, residual water is not in a previous gear position as has occurred with previous solutions. Additionally, water spray particle size, impact force, and water spray shape can be steplessly adjusted to meet shower needs of different people.

Embodiment 2

Figure 13:
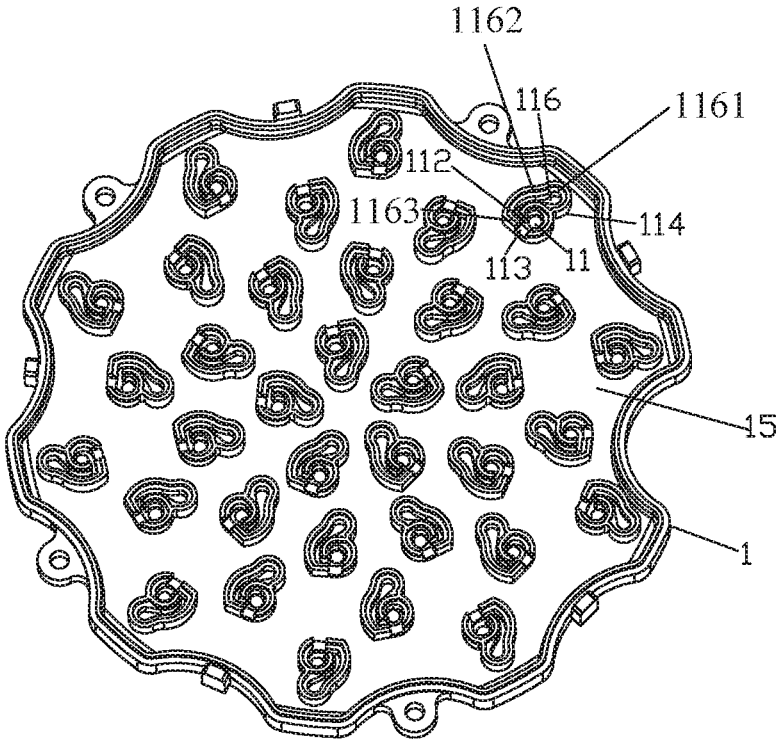
FIG. 13 illustrates a perspective view of a cover in Embodiment 2.
Figure 14:
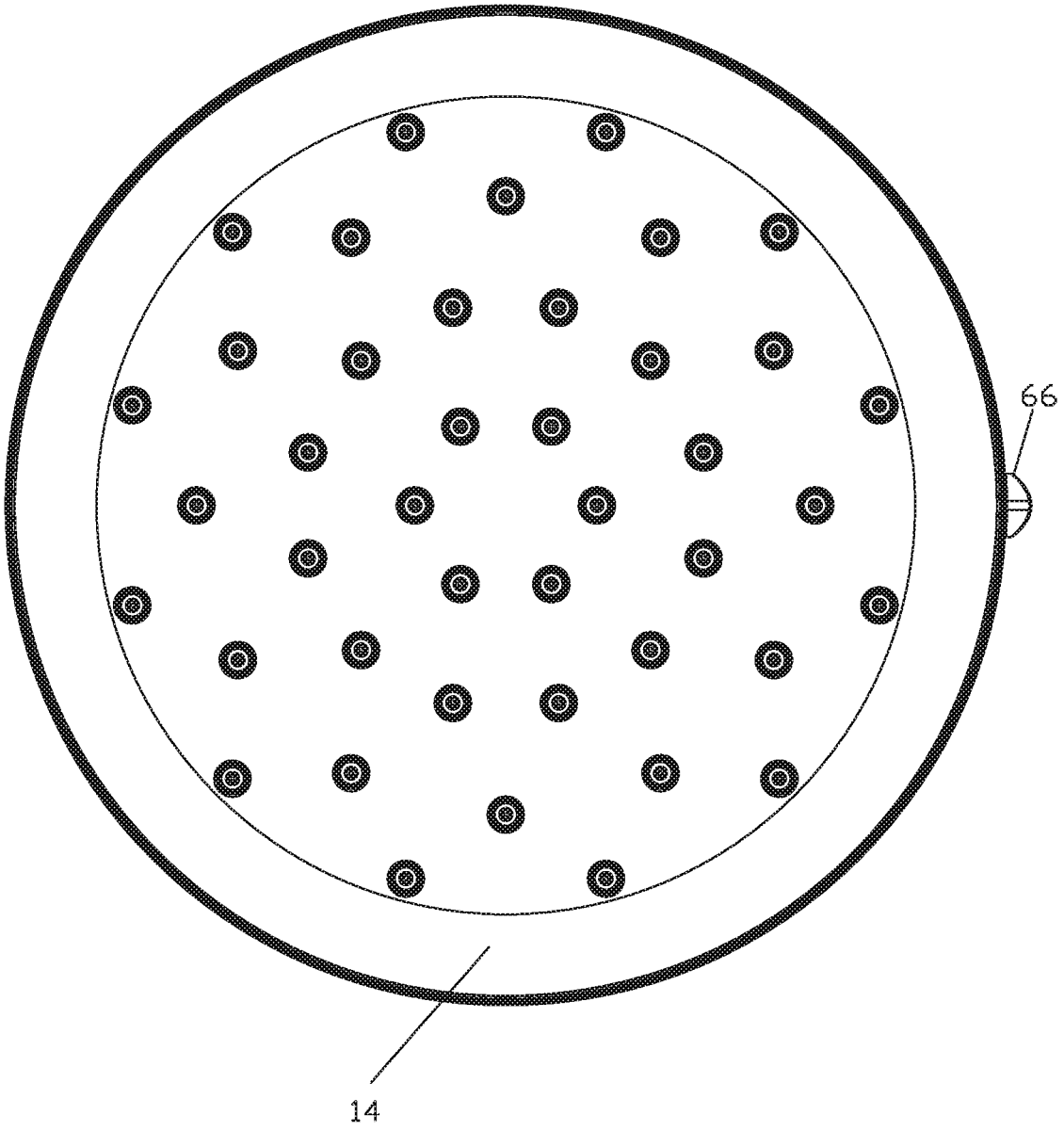
FIG. 14 illustrates a perspective view of a top shower in Embodiment 3.
Figure 15:
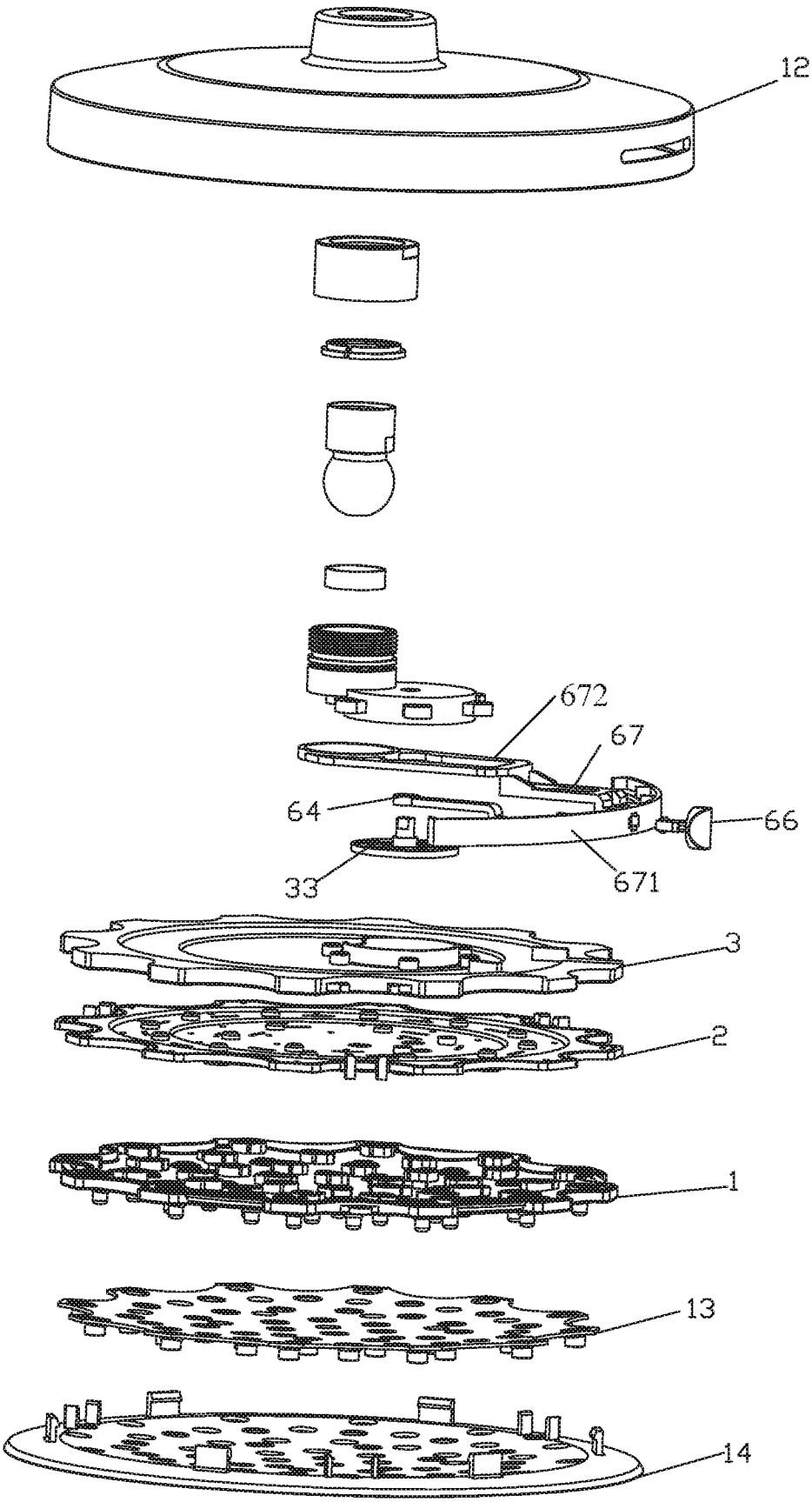
FIG. 15 illustrates an exploded perspective view of the top shower in Embodiment 3.
Figure 16:
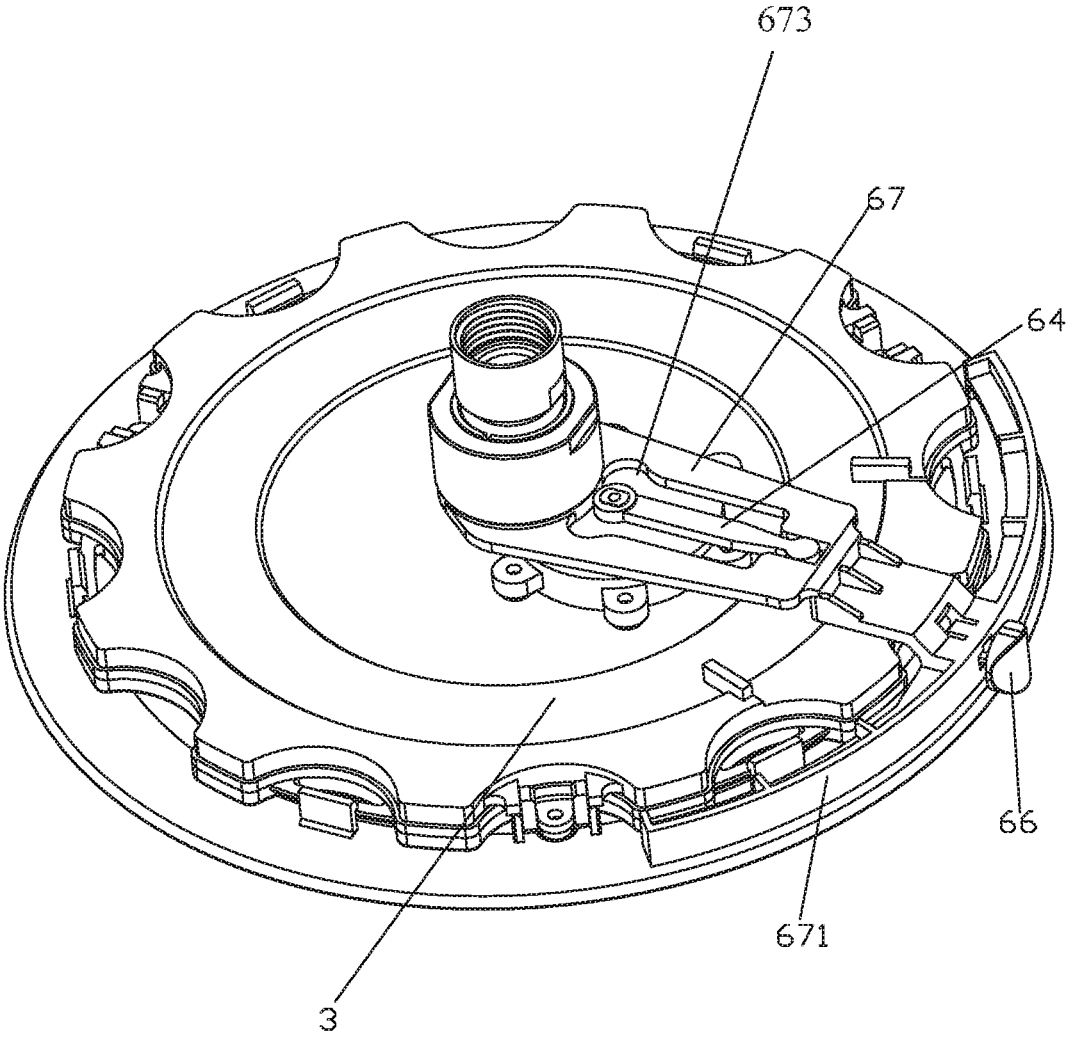
FIG. 16 illustrates a perspective view of a portion comprising a driving mechanism in Embodiment 3.
Figure 17:
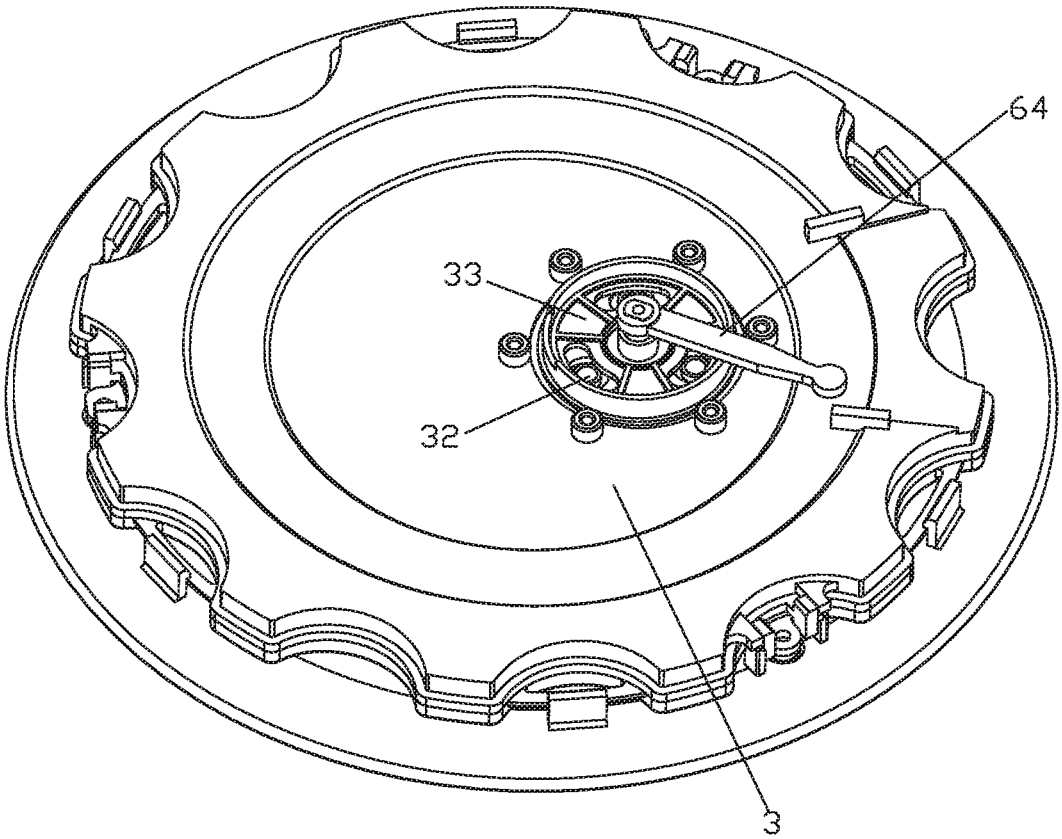
FIG. 17 illustrates a perspective view of a portion comprising a control mechanism in Embodiment 3.
Figure 18:
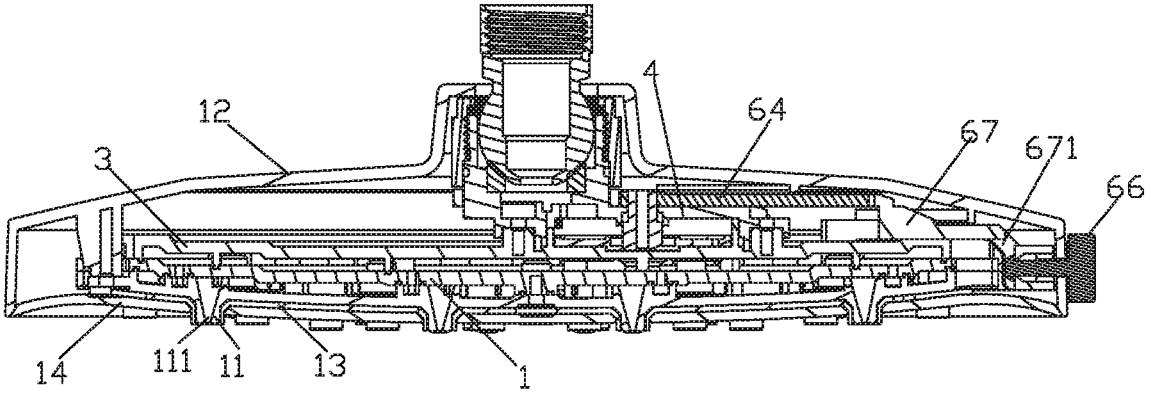
FIG. 18 illustrates a cross-sectional view of the top shower in Embodiment 3.
Figure 19:
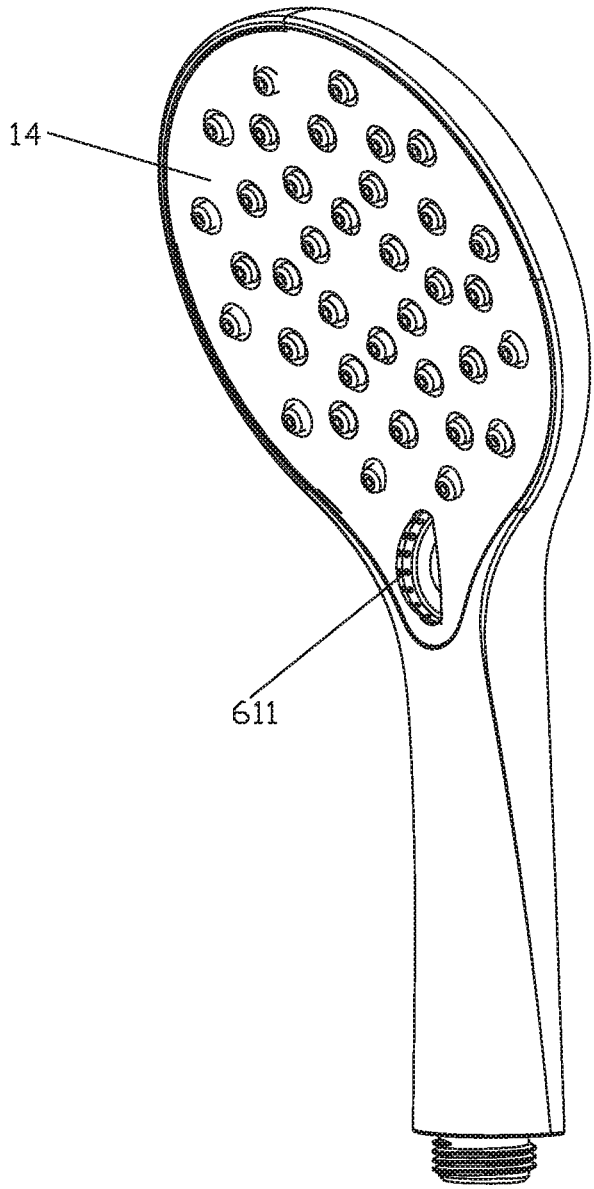
FIG. 19 illustrates a perspective view of a handheld shower in Embodiment 4.

Referring to FIG. 13, this embodiment differs from Embodiment 1 in that the water outlet nozzle 11 comprises a surrounding wall 114 protruding from the rear surface of the cover 1 and surrounding the inner port of the water outlet nozzle 11. The surrounding wall 114 comprises a through hole penetrating an inner side and an outer side. The through hole comprises the second water inlet 113, and the rear end surface of the surrounding wall 114 is further concave to define a water passing groove 116. A tail end of the water passing groove 116 defines the first water inlet 112, which is in communication with the water outlet nozzle 11. In this embodiment, the water passing groove 116 comprises a connecting section 1161, an arc section 1162, and a water inlet section 1163. The arc section is connected between the connecting section and the water inlet section, and the connecting section is disposed along a tangential line of the water outlet nozzle 11 and is disposed with the first water inlet 112.

Embodiment 3

Referring to FIGS. 14-18, this embodiment differs from Embodiments 1 and 2 in that the water outlet device is a top shower, and the driving mechanism 30 comprises a dial button 66, a dial rod 67, and a swing rod 64. The dial rod 67 comprises an arc-shaped member 671 and a connecting base 672 fixedly disposed on an inner wall of the arc-shaped member 671. An inner end of the connecting base 672 is rotatably connected to the installation portion 10. The connecting base 672 is concave to define a penetrating opening. An inward end surface of the penetrating opening is recessed to define a matching groove 673. An inner end of the swing rod 64 is fixedly connected to the water dividing shaft 331 of the water dividing plate 33. An outer end of the swing rod 64 protrudes to define a round portion, and the round portion is connected to an inner side of the matching groove 673. The dial button 66 is movably connected to the installation portion 10, and an inner end of the dial button 66 is disposed in the arc-shaped member 671. The dial button 66 slides back and forth to drive the arc-shaped member 671 to swing, to drive the connecting base to swing, and to drive an outer end of the swing rod 64 to move in an arc, and an inner end of the swing rod 64 drives the water dividing shaft 331 of the water dividing plate 33 to rotate. The driving mechanism 30 of this embodiment has a reasonable arrangement, a compact structure, and a stable and reliable transmission.

Embodiment 4

Referring to FIG. 21, this embodiment differs from Embodiments 1-3 in that the operation member is a roller 611. The roller 611 is operatively connected to the push rod 63, and the roller 611 is operatively connected to the installation portion 10. The roller 611 rotates to drive the push rod 63 to slide to drive the water dividing plate 33 to rotate.

The aforementioned embodiments are merely some embodiments of the present disclosure, and the scope of the disclosure of is not limited thereto. Thus, it is intended that the present disclosure cover any modifications and variations of the presently presented embodiments provided they are made without departing from the appended claims and the specification of the present disclosure.

What is claimed is:

1. A water outlet device for different water sprays from a same nozzle, comprising:
- a water outlet portion, and
- a control mechanism, wherein:
  - the water outlet portion comprises a water outlet nozzle,
  - the water outlet nozzle comprises a water outlet,
  - the water outlet nozzle further comprises at least two water inlets,
  - flow directions of the at least two water inlets are not parallel to a flow direction of the water outlet,
  - the control mechanism is connected to the at least two water inlets to control a water inlet condition of each of the at least two water inlets,
  - the water inlet condition comprises at least one of a flow volume or whether water is flowing or not flowing,
  - the control mechanism controls the water inlet condition of each of the at least two water inlets to enable the water outlet nozzle to discharge the different water sprays,
  - a flow direction of a first water inlet of the at least two water inlets is disposed along a direction tangent to the water outlet to enable water from the first water inlet to flow into the water outlet nozzle to generate a vortex,
  - a flow direction of a second water inlet of the at least two water inlets intersects with an axial direction of the water outlet nozzle, and
  - a bottom surface of the first water inlet is lower than a bottom surface of the second water inlet.

2. The water outlet device according to claim 1, wherein a linear extension of the first water inlet is disposed on a front side of the second water inlet.

3. The water outlet device according to claim 1, wherein the flow directions of the at least two water inlets are disposed on a same plane.

4. The water outlet device according to claim 1, wherein the flow directions of the at least two water inlets intersect.

5. The water outlet device according to claim 1, wherein a plane disposed with the flow directions of the at least two water inlets is perpendicular to the axial direction of the water outlet nozzle.

6. The water outlet device according to claim 1, comprising:
- an installation portion, wherein:
  - the installation portion comprises a cover and a cover plate body,
  - the cover is fixedly connected to the cover plate body,
  - the cover is disposed with the water outlet nozzle, and the cover plate body is hermetically connected to an inner port of the water outlet nozzle.

7. The water outlet device according to claim 6, wherein:

the water outlet nozzle is disposed with a surrounding wall protruding from a rear surface of the cover and surrounding the inner port of the water outlet nozzle, the surrounding wall comprises a through hole penetrating an inner side and an outer side of the surrounding wall, the through hole is disposed with the first water inlet, a rear end surface of the surrounding wall is concave to define the second water inlet in communication with the inner port of the water outlet nozzle, and the cover plate body is hermetically connected to and covers the rear end surface of the surrounding wall.

8. The water outlet device according to claim 7, wherein:

the surrounding wall comprises a curved wall and a protruding portion connected to two ends of the curved wall, a rear end surface of the protruding portion is concave to define a groove in communication with the inner port of the water outlet nozzle, and the groove defines the second water inlet.

9. The water outlet device according to claim 8, wherein the first water inlet is disposed at a connection position of the curved wall and the protruding portion.

10. The water outlet device according to claim 6, wherein:

the water outlet nozzle is disposed with a surrounding wall protruding from a rear surface of the cover and surrounding the inner port of the water outlet nozzle, the surrounding wall comprises a through hole penetrating an inner side and an outer side of the surrounding wall, the through hole is disposed with the second water inlet, a rear end surface of the surrounding wall is concave to define a groove, the groove comprises a water passing groove, and the water passing groove defines the first water inlet in communication with the inner port of the water outlet nozzle.

11. The water outlet device according to claim 10, wherein:

the water passing groove comprises a connecting section, an arc section, and a water inlet section, the arc section is connected between the connection section and the water inlet section, and the connecting section is disposed along a tangential line of the water outlet nozzle and is disposed with the first water inlet.

12. The water outlet device according to claim 6, wherein:

the cover is hermetically and fixedly connected to the cover plate body to define a water dividing chamber, the first water inlet is in communication with the water dividing chamber, and the cover plate body comprises a water passing hole in communication with the second water inlet.

13. The water outlet device according to claim 12, wherein:

the installation portion further comprises a water divider, a fixed base, and a water inlet passage, the water divider is hermetically and fixedly connected to the fixed base to define a water outlet chamber, the water inlet passage is in communication with the water outlet chamber, the water divider is hermetically and fixedly connected to the cover plate body to define another water dividing chamber, and the water passing hole is in communication with the another water dividing chamber, and the control mechanism is connected to the water outlet chamber, the water dividing chamber, and the another water dividing chamber.

14. The water outlet device according to claim 13, wherein:

the water divider comprises one or more water dividing holes selectively connected to the water dividing chamber and the another water dividing chamber, the control mechanism comprises a water dividing plate, and the water dividing plate is rotatably connected to the water divider to control the water dividing chamber and the another water dividing chamber to selectively be in communication with the one or more water dividing holes and to control the flow volume.

15. The water outlet device according to claim 14, comprising:

a driving mechanism, wherein:

the driving mechanism is operatively connected to the water dividing plate and drives the water dividing plate to achieve a stepless rotation adjustment.

16. The water outlet device according to claim 15, wherein:

the driving mechanism comprises a cam-connecting rod mechanism, and the cam-connecting rod mechanism is operatively connected to the water dividing plate to drive the water dividing plate to rotate.

17. The water outlet device according to claim 16, wherein:

the driving mechanism further comprises a slider, the cam-connecting rod mechanism comprises a push rod and a swing rod, the slider and the push rod are configured to slide relative to the installation portion, the slider is operatively connected to the push rod to enable the push rod to slide to drive the slider to slide, the push rod is connected with a connecting pin, the swing rod comprises a slot, the connecting pin is coupled in the slot, and the swing rod and the water dividing plate rotate synchronously.

18. The water outlet device according to claim 16, wherein:

the cam-connecting rod mechanism comprises a dial rod and a swing rod, one end of the dial rod is rotatably connected to the installation portion, one end of the swing rod is connected to the water dividing plate, another end of the swing rod is operatively connected to the dial rod, the dial rod rotates to drive the another end of the swing rod to swing, and the swing rod swings to drive the water dividing plate to rotate.

19. A water outlet device for different water sprays from a same nozzle, comprising:

a water outlet portion, an installation portion, and a control mechanism, wherein:

the water outlet portion comprises a water outlet nozzle, the water outlet nozzle comprises a water outlet, the water outlet nozzle further comprises at least two water inlets, flow directions of the at least two water inlets are not parallel to a flow direction of the water outlet, the control mechanism is connected to the at least two water inlets to control a water inlet condition of each of the at least two water inlets, the water inlet condition comprises at least one of a flow volume or whether water is flowing or not flowing, the control mechanism controls the water inlet condition of each of the at least two water inlets to enable the water outlet nozzle to discharge the different water sprays, the installation portion comprises a cover and a cover plate body, the cover is hermetically and fixedly connected to the cover plate body to define a water dividing chamber, a first water inlet of the at least two water inlets is in communication with the water dividing chamber, and the cover plate body comprises a water passing hole in communication with a second water inlet of the at least two water inlets.

20. The water outlet device according to claim 19, wherein:

a flow direction of the first water inlet is disposed along a direction tangent to the water outlet to enable water from the first water inlet to flow into the water outlet nozzle to generate a vortex.

21. The water outlet device according to claim 19, wherein:

a flow direction of the second water inlet intersects with an axial direction of the water outlet nozzle.

22. A water outlet device for different water sprays from a same nozzle, comprising:

a water outlet portion, an installation portion, and a control mechanism, wherein:

the water outlet portion comprises a water outlet nozzle, the water outlet nozzle comprises a water outlet, the water outlet nozzle further comprises at least two water inlets, flow directions of the at least two water inlets are not parallel to a flow direction of the water outlet, the control mechanism is connected to the at least two water inlets to control a water inlet condition of each of the at least two water inlets, the water inlet condition comprises at least one of a flow volume or whether water is flowing or not flowing, the control mechanism controls the water inlet condition of each of the at least two water inlets to enable the water outlet nozzle to discharge the different water sprays, the installation portion comprises a cover and a cover plate body, the cover is fixedly connected to the cover plate body, the cover is disposed with the water outlet nozzle, the cover plate body is hermetically connected to an inner port of the water outlet nozzle, the water outlet nozzle is disposed with a surrounding wall protruding from a rear surface of the cover and surrounding the inner port of the water outlet nozzle, the surrounding wall comprises a through hole penetrating an inner side and an outer side of the surrounding wall, the through hole is disposed with a first water inlet of the at least two water inlets, a rear end surface of the surrounding wall is concave to define a second water inlet of the at least two water inlets in communication with the inner port of the water outlet nozzle, and the cover plate body is hermetically connected to and covers the rear end surface of the surrounding wall.

* * * * *